US008303892B2

(12) United States Patent
Sheth et al.

(10) Patent No.: US 8,303,892 B2
(45) Date of Patent: Nov. 6, 2012

(54) COMPOSITION AND METHOD OF FORMING HIGH PRODUCTIVITY, CONTINUOUS CASTING ROLL SHELL ALLOY

(75) Inventors: Harshad V. Sheth, Rancho Palos Verdes, CA (US); James N. Cordea, Largo, FL (US)

(73) Assignee: Shultz Steel Company, South Gate, CA (US)

( * ) Notice: Subject to any disclaimer, the term of this patent is extended or adjusted under 35 U.S.C. 154(b) by 344 days.

(21) Appl. No.: 12/288,750

(22) Filed: Oct. 22, 2008

(65) Prior Publication Data

US 2010/0098578 A1 Apr. 22, 2010

(51) Int. Cl.
*C22C 38/44* (2006.01)
*C22C 38/46* (2006.01)

(52) U.S. Cl. ..... 420/109; 148/335; 492/54

(58) Field of Classification Search ..... 420/109; 148/335; 492/54
See application file for complete search history.

(56) References Cited

U.S. PATENT DOCUMENTS 4,409,027 A 10/1983 Cordea et al.
4,772,451 A 9/1988 Andreini et al.
4,861,549 A 8/1989 Khare
5,059,389 A * 10/1991 Finkl et al. ..... 420/67
5,531,659 A 7/1996 Fusada
5,599,497 A 2/1997 Cordea et al.
5,792,286 A 8/1998 Inoue et al.
5,948,354 A 9/1999 Odin et al.
6,232,000 B1 5/2001 Singh et al.
7,067,019 B1 6/2006 Fedchun et al.

* cited by examiner

*Primary Examiner* — Deborah Yee

(74) *Attorney, Agent, or Firm* — McKenna Long & Aldridge LLP

(57) ABSTRACT

A lean alloy steel and roll shells made of same are provided. The lean alloy steel has improved properties in imparting high productivity and long service life for roll shells (or roll caster shells) utilized in the direct casting of molten materials (such as molten aluminum) to strips. The lean alloy steel includes iron (Fe) alloyed with carbon (C), chromium (Cr), molybdenum (Mo), vanadium (V), manganese (Mn), nickel (Ni), phosphorus (P), sulfur (S), silicon (Si), and/or niobium (Nb). The roll shells made from the heat treated lean alloy steel have high resistance to surface heat checking due to its very high yield strengths at molten aluminum temperatures (made, e.g., possible with its high carbide content), and have high casting speeds because of its high thermal conductivity (made, e.g., possible with its lean alloy composition).

32 Claims, 14 Drawing Sheets

FIG. 2

Composition of Roll Shell Alloys - (wt. %)

| Lab Heats | Alloy Group | C | Mn | P | S | Si | Ni | Cr | Mo | V | Cu | Al | Nb | Total Alloy |
|---|---|---|---|---|---|---|---|---|---|---|---|---|---|---|
| HTC-1 | 1Cr.5Mo.5C.3V | 0.51 | 0.48 | 0.002 | 0.001 | 0.15 | 0.53 | 1.01 | 0.49 | 0.3 | 0.01 | 0.022 | | 3.505 |
| HTC-2 | 1Cr.5Mo.5C.5V | 0.52 | 0.49 | 0.002 | 0.001 | 0.15 | 0.52 | 1 | 0.48 | 0.47 | 0.01 | 0.016 | | 3.659 |
| T-245 | 1Cr.5Mo.5C.1V | 0.47 | 0.51 | 0.002 | 0.001 | 0.15 | 0.53 | 1.03 | 0.49 | 0.12 | 0.01 | 0.021 | | 3.334 |
| T244LoCrMo+Nb | 1Cr.5Mo.5C..3V.04Nb | 0.47 | 0.49 | 0.003 | 0.001 | 0.15 | 0.51 | 1 | 0.49 | 0.29 | 0.01 | 0.022 | 0.041 | 3.477 |
| T244-L-Mo | 2Cr.5Mo.5C.3V | 0.51 | 0.49 | 0.002 | 0.001 | 0.14 | 0.52 | 2.01 | 0.49 | 0.31 | 0.01 | 0.019 | | 4.502 |
| T-244-LCr | 1Cr1Mo.5C.3V | 0.52 | 0.48 | 0.002 | 0.001 | 0.14 | 0.52 | 0.96 | 0.91 | 0.31 | 0.01 | 0.018 | | 3.871 |
| T244LoCrC | 1Cr1Mo.3C.3V | 0.27 | 0.48 | 0.003 | 0.001 | 0.14 | 0.51 | 1.02 | 1.02 | 0.3 | 0.01 | 0.01 | | 3.764 |
| T244LoCrC+Nb | 1Cr1Mo.3C.3V.05Nb | 0.28 | 0.48 | 0.001 | 0.001 | 0.15 | 0.51 | 0.98 | 0.98 | 0.29 | 0.01 | 0.004 | 0.047 | 3.733 |
| Base T244 | 2Cr1Mo.5C.3V | 0.51 | 0.5 | 0.002 | 0.001 | 0.15 | 0.52 | 2 | 0.91 | 0.31 | 0.01 | 0.02 | | 4.933 |
| **Production Heats** | | | | | | | | | | | | | | |
| T-244(Ht.R-4673) | 2Cr1Mo.5C.3V | 0.52 | 0.52 | 0.011 | 0.003 | 0.15 | 0.49 | 2 | 0.93 | 0.31 | 0.16 | 0.01 | | 5.104 |
| T-244(G-5522) | 2Cr1Mo.5C.3V | 0.54 | 0.5 | 0.009 | 0.001 | 0.18 | 0.49 | 2.02 | 0.91 | 0.31 | 0.15 | 0.011 | | 5.121 |
| HS-521(HtR-4501) | 3Cr1Mo.3C.4V | 0.3 | 0.49 | 0.013 | 0.001 | 0.14 | 0.45 | 3.06 | 0.99 | 0.43 | 0.2 | 0.012 | | 6.086 |
| HS-521(G-5400) | 3Cr1.5Mo.3C.4V | 0.33 | 0.33 | 0.004 | 0.001 | 0.29 | 0.23 | 2.97 | 1.42 | 0.18 | 0.07 | 0.006 | | 5.831 |
| Comparative | 3Cr1Mo.35C.2V | 0.34 | 0.32 | 0.005 | 0.001 | 0.34 | 0.13 | 2.96 | 1.04 | 0.18 | 0.03 | 0.009 | | 5.355 |
| HSC-621 (Ht.T-5958) | 1Cr1Mo.35C.3V.03Nb | 0.33 | 0.49 | 0.007 | 0.001 | 0.16 | 0.49 | 1 | 1.03 | 0.31 | 0.05 | 0.019 | 0.033 | 3.92 |

FIG. 3

Room Temperature Mechanical Properties of Roll Shell Alloys

| Lab Heats | Alloy Group | Room Temperature Yield Str. (ksi) | Tens.Str. (ksi) | BHN | % Elong. | % R.A. |
|---|---|---|---|---|---|---|
| HTC-1 | 1Cr.5Mo.5C.3V | 195 | 213 | 444 | 14 | 41 |
| HTC-2 | 1Cr.5Mo.5C.5V | 197 | 212 | 444 | 13 | 38 |
| T-245 | 1Cr.5Mo.5C.1V | 182 | 202 | 429 | 13 | 37 |
| T244LoCrMo+Nb | 1Cr.5Mo.5C..3V.04Nb | 196 | 211 | 444 | 14 | 41 |
| T244-L-Mo | 2Cr.5Mo.5C.3V | 185 | 212 | 444 | 13 | 35 |
| T-244-LCr | 1Cr1Mo.5C.3V | 211 | 230 | 477 | 12 | 33 |
| T244LoCrC | 1Cr1Mo.3C.3V | 177 | 196 | 401 | 18 | 63 |
| T244LoCrC+Nb | 1Cr1Mo.3C.3V.05Nb | 191 | 202 | 401 | 17 | 58 |
| Base T244 | 2Cr1Mo.5C.3V | 194 | 222 | 461 | 13 | 35 |
| **Production Heats** | | | | | | |
| T-244(Ht.R-4673) | 2Cr1Mo.5C.3V | 193 | 217 | 444 | 13 | 45 |
| T-244(G-5522) | 2Cr1Mo.5C.3V | 201 | 228 | - | 14 | 42 |
| HS-521(HtR-4501) | 3Cr1Mo.3C.4V | 188 | 212 | 428 | 17 | 56 |
| HS-521(G-5400) | 3Cr1.5Mo.3C.4V | 167 | 192 | - | 14 | 50 |
| Comparative | 3Cr1Mo.35C.2V | 175 | 201 | 401 | 14 | 40 |
| HSC-621 (Ht.T-5958) | 1Cr1Mo.35C.3V.03Nb | 167 | 185 | 401 | 17 | 55 |

FIG. 4

Elevated Temperature (1200F) Mechanical Properties of Roll Shell Alloys

| Lab Heats | Alloy Group | Yield Str. (ksi) | Tens.Str. (ksi) | % Elong. | % R.A. |
|---|---|---|---|---|---|
| HTC-1 | 1Cr.5Mo.5C.3V | 47 | 70 | 35 | 93 |
| HTC-2 | 1Cr.5Mo.5C.5V | 39 | 56 | 32 | 96 |
| T-245 | 1Cr.5Mo.5C.1V | 46 | 70 | 32 | 92 |
| T244LoCrMo+Nb | 1Cr.5Mo.5C..3V.04Nb | 49 | 70 | 34 | 94 |
| T244-L-Mo | 2Cr.5Mo.5C.3V | 51 | 78 | 31 | 93 |
| T-244-LCr | 1Cr1Mo.5C.3V | 65 | 89 | 28 | 88 |
| T244LoCrC | 1Cr1Mo.3C.3V | 79 | 101 | 21 | 79 |
| T244LoCrC+Nb | 1Cr1Mo.3C.3V.05Nb | 80 | 93 | 21 | 82 |
| Base T244 | 2Cr1Mo.5C.3V | 64 | 85 | 30 | 91 |
| **Production Heats** | | | | | |
| T-244(Ht.R-4673) | 2Cr1Mo.5C.3V | 52 | 81 | 33 | 95 |
| T-244(G-5522) | 2Cr1Mo.5C.3V | 49 | 71 | 43 | 96 |
| HS-521(HtR-4501) | 3Cr1Mo.3C.4V | 75 | 92 | 25 | 85 |
| HS-521(G-5400) | 3Cr1.5Mo.3C.4V | 61 | 76 | 28 | 91 |
| Comparative | 3Cr1Mo.35C.2V | 70 | 87 | 28 | 93 |
| HSC-621 (Ht.T-5958) | 1Cr1Mo.35C.3V.03Nb | 72 | 88 | 22 | 68 |

FIG. 5

Thermal Conductivity of Roll Shell Alloys (Btu-in/hr-ft$^{2}$-°F)

| Lab Heats | Alloy Group | 75°F | 390°F | 500°F |
|---|---|---|---|---|
| HTC-1 | 1Cr.5Mo.5C.3V | 301 | 296 | |
| HTC-2 | 1Cr.5Mo.5C.5V | 313 | 306 | |
| T-245 | 1Cr.5Mo.5C.1V | 308 | 304 | |
| T244LoCrMo+Nb | 1Cr.5Mo.5C..3V.04Nb | 328 | 302 | |
| T244-L-Mo | 2Cr.5Mo.5C.3V | 309 | 309 | |
| T-244-LCr | 1Cr1Mo.5C.3V | 322 | 317 | |
| T244LoCrC | 1Cr1Mo.3C.3V | 283 | 289 | |
| T244LoCrC+Nb | 1Cr1Mo.3C.3V.05Nb | 288 | 295 | |
| Base T244 | 2Cr1Mo.5C.3V | 286 | 288 | |
| **Production Heats** | | | | |
| T-244(Ht.R-4673) | 2Cr1Mo.5C.3V | 269 | 269 | |
| T-244(G-5522) | 2Cr1Mo.5C.3V | 266 | | 274 |
| HS-521(HtR-4501) | 3Cr1Mo.3C.4V | 235 | 246 | |
| HS-521(G-5400) | 3Cr1.5Mo.3C.4V | 250 | | 258 |
| Comparative | 3Cr1Mo.35C.2V | 228 | 248 | |
| HSC-621 (Ht.T-595 | 1Cr1Mo.35C.3V.03Nb | 287 | | 280 |

FIG. 6 - Total Alloy Content vs. Thermal Conductivity @ Room Temperature

Fig.7 - Total Alloy Content vs. 1200F Yield Strength

Fig.8 - Cr+Mo+V Content vs. 1200F Yield Strength

Fig. 9 - Mo +V vs. 1200 F Yield Strength

Fig. 10 Effect of Mo on 1200 Yield Strength

Fig. 11 - Effect of V Content on 1200F Yield Strength

Fig. 12 - Effect of Cr Content on 1200F Yield Strength

FIG. 13

C as Alloy Carbide (VC + $Mo_2C$ + NbC)

| Lab Heats | Alloy Group | Total % C | %C as VC | %C as $Mo_2C$ | %C as NbC | Total %C as Carbide | (% C as Carbide /Total % C) x 100 (%) |
|---|---|---|---|---|---|---|---|
| HTC-1 | 1Cr.5Mo.5C.3V | 0.51 | 0.071 | 0.031 | 0.000 | 0.101 | 19.89 |
| HTC-2 | 1Cr.5Mo.5C.5V | 0.52 | 0.111 | 0.030 | 0.000 | 0.141 | 27.09 |
| T-245 | 1Cr.5Mo.5C.1V | 0.47 | 0.028 | 0.031 | 0.000 | 0.059 | 12.55 |
| T244LoCrMo+Nb | 1Cr.5Mo.5C..3V.04Nb | 0.47 | 0.068 | 0.031 | 0.005 | 0.104 | 22.2 |
| T244-L-Mo | 2Cr.5Mo.5C.3V | 0.51 | 0.073 | 0.031 | 0.000 | 0.104 | 20.35 |
| T-244-LCr | 1Cr1Mo.5C.3V | 0.52 | 0.073 | 0.057 | 0.000 | 0.130 | 25.01 |
| T244LoCrC | 1Cr1Mo.3C.3V | 0.27 | 0.071 | 0.064 | 0.000 | 0.135 | 49.85 |
| T244LoCrC+Nb | 1Cr1Mo.3C.3V.05Nb | 0.28 | 0.068 | 0.061 | 0.006 | 0.136 | 48.5 |
| Base T244 | 2Cr1Mo.5C.3V | 0.51 | 0.073 | 0.057 | 0.000 | 0.130 | 25.5 |
| **Production Heats** | | | | | | | |
| T-244(Ht.R-4673) | 2Cr1Mo.5C.3V | 0.52 | 0.073 | 0.058 | 0.000 | 0.131 | 25.25 |
| T-244(G-5522) | 2Cr1Mo.5C.3V | 0.54 | 0.073 | 0.057 | 0.000 | 0.130 | 24.09 |
| HS-521(HtR-4501) | 3Cr1Mo.3C.4V | 0.3 | 0.101 | 0.062 | 0.000 | 0.163 | 54.46 |
| HS-521(G-5400) | 3Cr1.5Mo.3C.4V | 0.33 | 0.042 | 0.089 | 0.000 | 0.131 | 39.79 |
| Comparative | 3Cr1Mo.35C.2V | 0.34 | 0.042 | 0.065 | 0.000 | 0.108 | 31.63 |
| HSC-621 (Ht.T-5958) | 1Cr1Mo.35C.3V.03Nb | 0.33 | 0.073 | 0.064 | 0.004 | 0.142 | 42.98 |

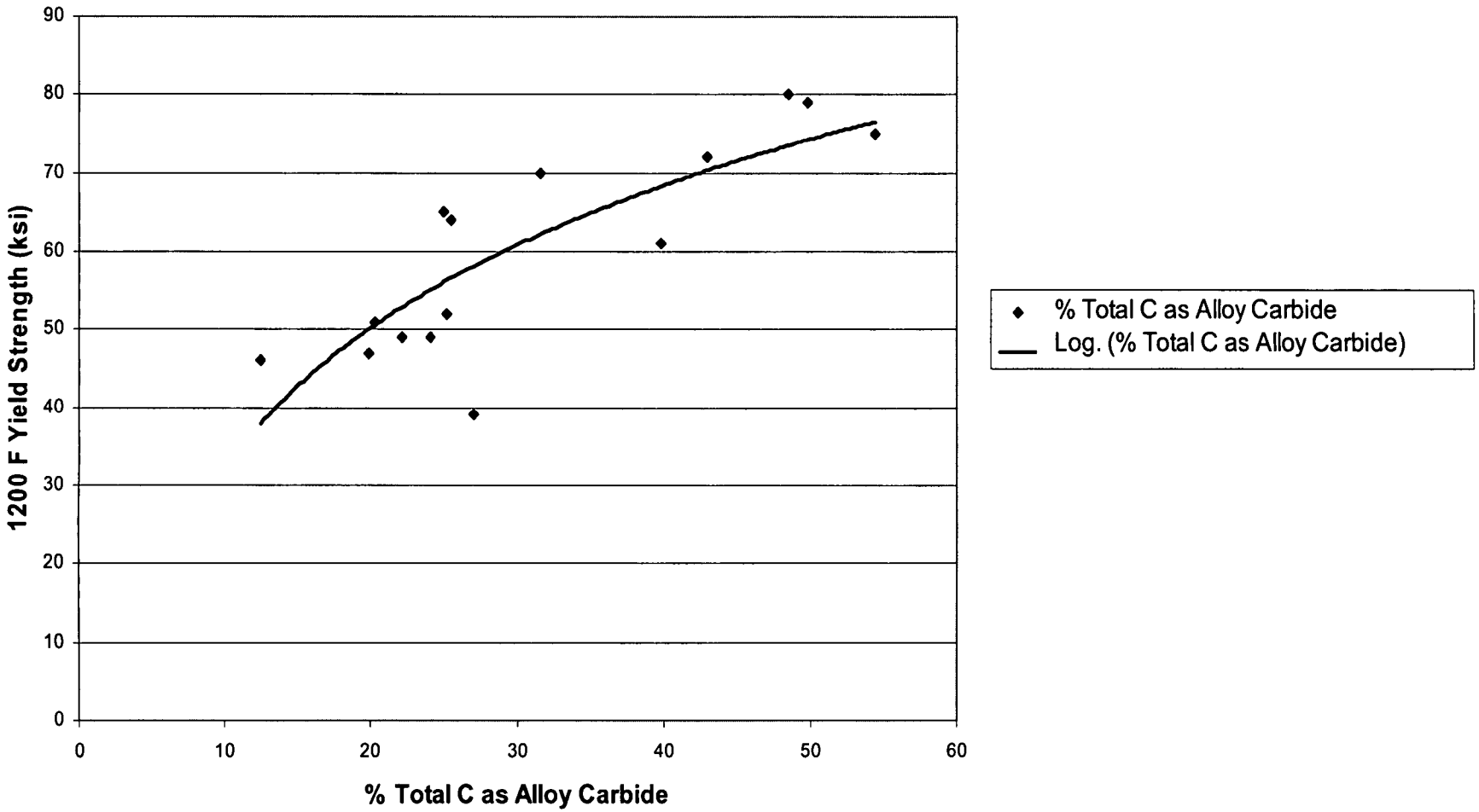
Fig. 14 - %Total C as Alloy Carbide vs. 1200F Yield Strength

COMPOSITION AND METHOD OF FORMING HIGH PRODUCTIVITY, CONTINUOUS CASTING ROLL SHELL ALLOY

FIELD OF THE INVENTION

The present invention relates to steel alloys in casting roll shells (or roll caster shells) utilized in the direct casting of molten materials (such as molten aluminum materials) to strips, and methods of forming the same.

BACKGROUND OF THE INVENTION

Heat treated steel alloys have been utilized to die cast molten aluminum and other alloys into solid shapes for many years. The higher melting temperature of steel, about twice that of aluminum, allows it to cool and solidify the aluminum when they come into contact. It may also be used to solidify other lower melting temperature metals or alloys containing large amount of lead, zinc, magnesium, copper, tin, etc.

This same characteristic has been effectively utilized for direct casting of molten aluminum materials (e.g., molten aluminum) to strip form using water-cooled, roll caster shells made of steel alloy (or alloy steel). The molten aluminum is made to flow between two rotating roll caster shells mounted on water-cooled cores. The caster shells extract heat, so that the temperature of the aluminum falls below its melting point and becomes slightly solidified. In this way, a solid aluminum strip can be formed by pulling out from the opposite side.

Because the surfaces of the roll caster shells experience a thermal cycle or a drastic change in temperature from near room temperature to the temperature of molten aluminum (about 1250° F.) as they revolve, numerous small cracks eventually form on the shell surfaces. These cracks (or "heat checks") are formed by a mechanism known as thermal fatigue, as discussed in U.S. Pat. No. 4,409,027, which is incorporated by reference herein in its entirety. The small surface cracks referred to as "heat checks" or "craze cracks" by those in the industry, eventually grow to the point where they can create marks on the surface of the aluminum strip that even subsequent cold rolling cannot remove the crack patterns from the aluminum strip. At that point, the casting operation must be shut down, the rolls have to be removed and the shell surfaces have to be machined down to their original crack-free condition. Casting may then begin again. However, crack formation, recurs after repeated use. Because of the thermal cycling driving their formation, they can never be fully eliminated. Consequently, the metallurgical design of the shell steel or particularly its alloy is based on retarding the onset of these defects in order to lengthen the service life of the roll shells.

To design an alloy for desired performance and production life, several material properties are considered and controlled. A more detailed description of these material properties and their effect on performance and production life of roll shell alloys is set forth in U.S. Pat. No. 4,409,027, and in U.S. Pat. No. 5,599,497, all of which are incorporated by reference herein in their entirety. As discussed in U.S. Pat. Nos. 4,409,027 and 5,599,497, the desired material properties have low thermal expansion coefficient, high thermal conductivity, high elevated temperature yield strength, high elevated temperature ductility, and a low modulus of elasticity. The most easily controlled property in steel alloys of this type is to increase the elevated temperature yield strength by the additional of selected alloying elements. However, attempts to provide higher elevated temperature yield strength usually result in lower thermal conductivity of the alloyed roll shells.

As such, although some improvements in service life were obtained for roll shells by elevating the temperature yield strength, the resulting reduction of thermal conductivity of the roll shells (which reduces aluminum strip production yield) may offset any gain achieved by the elevation of the temperature yield strength. That is, in a conventional roll shell, high temperature yield strength results in low thermal conductivity.

Accordingly, there is a need for roll shells with alloys that can provide the roll shells with not only high temperature yield strength, but also with high thermal conductivity.

SUMMARY OF THE INVENTION

Aspects of embodiments of the present invention are directed toward alloys for roll shells having both high elevated temperature yield strength and thermal conductivity. That is, in certain embodiments, of all the desired material properties discussed in U.S. Pat. Nos. 4,409,027 and 5,599,497 (such as the low thermal expansion coefficient, high thermal conductivity, high elevated temperature yield strength, high elevated temperature ductility, and a low modulus of elasticity), only the elevated temperature yield strength and thermal conductivity can be controlled by additions or elimination of certain alloys.

In one embodiment, the present invention provides a lean alloy steel with improved properties capable of providing high productivity and long service life for roll shells (or roll caster shells) utilized in the direct casting of molten materials, such as molten aluminum to strips. In various embodiments, roll shells that are made from properly heat treated lean alloy steel have high resistance to surface heat checking by developing very high yield strength at molten aluminum temperatures. Further, these roll shells have high casting speeds because of the high thermal conductivity made possible with the lean alloy composition. The lean alloy steel is composed of iron (Fe) alloyed with various alloying materials, such as carbon (C), chromium (Cr), molybdenum (Mo), vanadium (V), manganese (Mn), nickel (Ni), phosphorus (P), sulfur (S), silicon (Si), and/or niobium (Nb). In various embodiments, the total alloying material content or lean alloy composition (except for Fe) in the lean alloy steel is less than 5 wt % of the lean alloy steel, or more specifically, less than 4 wt % of the lean alloy steel.

In one embodiment, a roll caster shell for casting aluminum material is provided. The roll caster shell includes iron (Fe) alloyed with a lean alloy composition, which includes in weight percent (%) of the shell, from about 0.20% to about 0.60% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% nickel (Ni), up to about 0.02% phosphorus (P), up to about 0.020% sulfur (S), and up to about 0.40% silicon (Si).

The lean alloy composition may include about 0.03% to about 0.06% niobium (Nb), about 1.0% Mo, about 0.30% V, and about 1.0% Cr.

In another embodiment, a lean alloy composition of a roll caster shell includes in weight percent (%) of the shell, from about 0.25% to about 0.45% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, up to about 0.35% Si, and from about 0.03% to about 0.06% Nb.

In yet another embodiment, a lean alloy composition of a roll caster shell includes in weight percent (%) of the shell, from about 0.25% to about 0.35% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, up to about 0.25% Si, and from about 0.03% to about 0.05% Nb.

In another embodiment, a lean alloy composition of a roll caster shell includes in weight percent (%) of the shell, from about 0.25% to about 0.45% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, and up to about 0.35% Si.

In another embodiment, a lean alloy composition of a roll caster shell includes in weight percent (%) of the shell, from about 0.25% to about 0.35% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, and up to about 0.25% Si.

The roll caster shell having a lean alloy composition may include in weight percent (%) of the shell about 1.0% Mo, about 0.30% V, and about 1.0% Cr. In one embodiment, a lean alloy composition includes more than 1.2% and to about 1.5% Mo, less than 0.35% C and less than 0.30% V.

In one embodiment, a lean alloy composition of a roll caster shell includes, in weight percent (%) of the shell, more than 1.2% and to about 1.5% Mo, and from about 0.8% to about 0.9% Cr. In another embodiment, the lean alloy composition further includes from about 0.35% to about 0.45% V, and hydrogen at a concentration up to 1.5 ppm based on total weight of the shell.

In one embodiment, the roll caster shell is a tube having substantially uniform martensite crystalline structure.

Another aspect of an embodiment of the present invention is directed toward an alloy steel utilized to form a roll caster shell, the alloy steel includes iron (Fe) alloyed with a lean alloy composition. The lean alloy composition includes in weight percent (%) of the alloy steel, from about 0.20% to about 0.60% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% Ni, up to about 0.02% phosphorus (P), up to about 0.02% sulfur (S), and up to about 0.40% silicon (Si).

In one embodiment, the alloy steel further includes from about 0.03% to about 0.06% niobium (Nb).

In other embodiments, the alloy steel includes various lean alloy compositions as previously described above.

Another aspect of an embodiment of the present invention is directed toward an alloy steel utilized to form a roll caster shell. The alloy steel includes, in weight percent (%), from about 0.20% to about 0.60% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% Ni, up to about 0.02% phosphorus (P), up to about 0.02% sulfur (S), and up to about 0.40% silicon (Si), from about 0.03% to about 0.06% niobium (Nb), and balance essentially iron (Fe).

In one embodiment, an alloy steel includes from about 0.25% to about 0.45% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, up to about 0.35% Si, from about 0.03% to about 0.06% Nb, and balance essentially Fe.

In another embodiment, an alloy steel includes from about 0.25% to about 0.35% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, up to about 0.25% Si, and from about 0.03% to about 0.05% Nb, and balance essentially Fe.

The aforementioned alloy steel is a lean alloy steel and may include hydrogen at a concentration up to 1.5 ppm based on total weight of the alloy steel.

BRIEF DESCRIPTION OF THE DRAWINGS

The accompanying figures, together with the specification, illustrate exemplary embodiments of the present invention, and, together with the description, serve to explain the principles of the present invention.

FIG. 2 is a table of roll shell alloys and the composition content of each alloy according to various embodiments of the present invention;

FIG. 3 is a table of roll shell alloys and mechanical properties of each at room temperature according to various embodiments of the present invention;

FIG. 4 is a table of roll shell alloys and mechanical properties of each at an elevated temperature according to various embodiments of the present invention;

FIG. 5 is a table of thermal conductivity of different alloys according to certain embodiments of the present invention;

FIG. 13 is a table of different alloys and the total carbon as alloy carbide according to various embodiments of the present invention; and FIG. 14 is a graph illustrating the yield strength at 1200° F. of an alloy as a function of the C content according to various embodiments of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
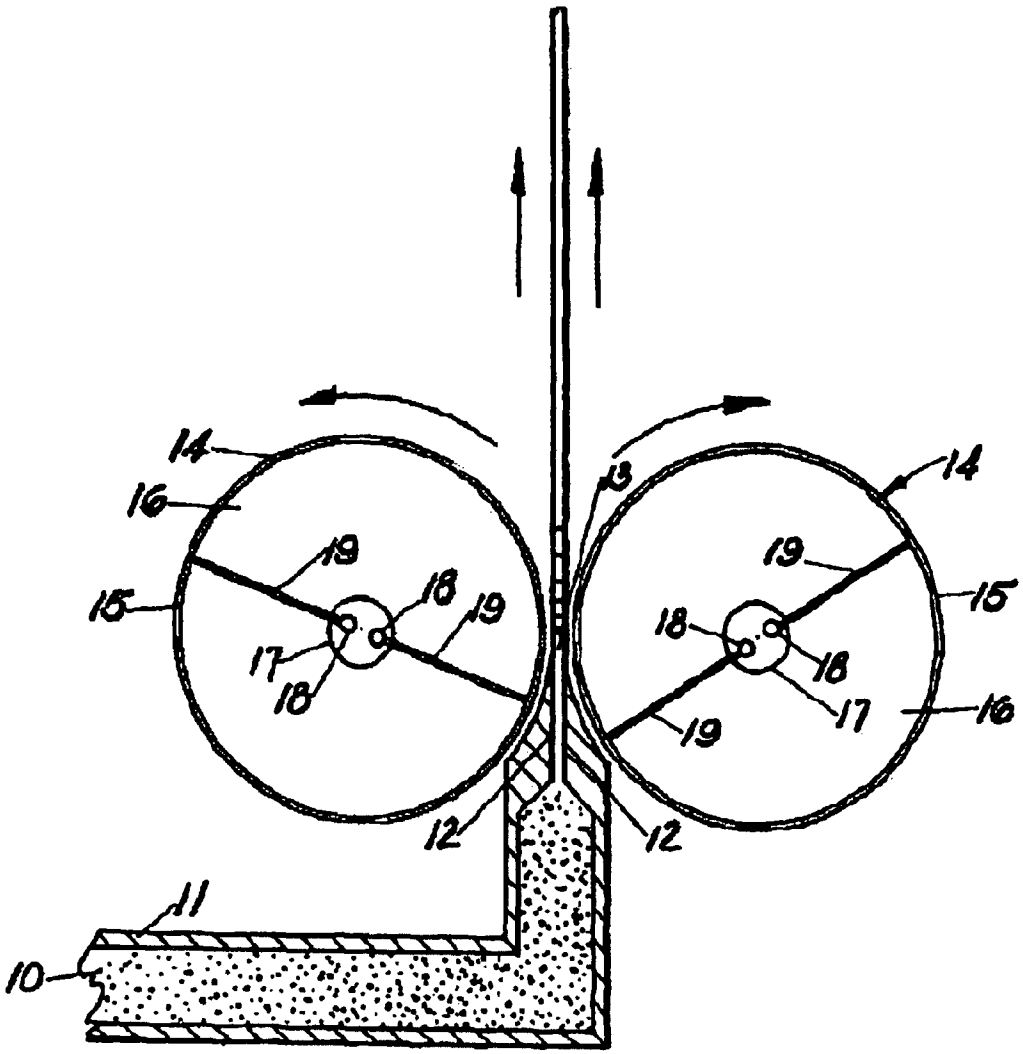
FIG. 1 is a diagram of a cross sectional view of an aluminum strip caster illustrating water cooled roll caster shells.

Referring to FIG. 1, a representative type of vertical caster for a molten material, such as molten aluminum is shown. Here, in one embodiment, molten aluminum is maintained at a constant level in a headbox positioned in such manner that the molten aluminum (or molten metal), indicated at 10, flows by gravity into a distribution box indicated at 11 in which it is directed upwardly through a lip assembly 12 into a freezing zone 13. A pair of water-cooled rolls, indicated generally at 14, is provided which are driven in counter-rotating directions as shown by arrows in FIG. 1. The bite of the rolls is slightly above the freezing zone 13, so that the molten aluminum solidifies just before reaching the bite of the rolls and is hot rolled as it passes therebetween.

Each caster roll 14 is composed of a roll shell 15 which is a forged, heat treated hollow cylinder. A core 16 is provided on which the outer shell 15 is mounted by a shrink fit, i.e., the shell is heated, causing it to expand, and is slipped over the core. The shell then shrinks upon cooling to fit tightly around the core. An axial drive shaft 17 is provided with cooling water inlet and outlet channels 18. Radial tubes 19 connecting with channels 18 are provided to conduct cooling water outwardly to the inner surface of the shell 15.

Historically, H-13 steel (typically includes 0.35% C, etc.) has been a standard heat-treated, alloy steel used in aluminum die casting, but it is expensive and can be difficult to handle in roll shell applications. Various embodiments of the present invention are directed toward the outer roll caster shell 15 thereof, which is described in more detail below.

As indicated herein, lean alloy steels according to various embodiment of the present invention have been found to prolong the service life and increase the casting speed of roll caster shells of the type illustrated in FIG. 1. This is possible because of the properly heat-treated lean alloy steel's relatively high yield strength at elevated temperature (e.g., at molten aluminum temperatures) and high thermal conductivity due to the lean total alloy content.

In various embodiments of the present invention, the phrase "total alloy content (or total alloy)" refers to the amount of material content alloyed with iron (Fe). That is, total alloy content (or total alloy) can refer to the total amount of elements in a lean alloy steel other than Fe.

In one embodiment, the roll shells are made with heat treated lean alloy steel, which includes a high carbide content and an overall lean alloy composition. As a result, the roll shells have high resistance to surface heat checking due to its high yield strength at molten aluminum temperatures and high casting speeds because of its high thermal conductivity.

In various embodiments of the present invention, the weight percentage of alloying materials, such as carbon (C), chromium (Cr), molybdenum (Mo), vanadium (V), manganese (Mn), nickel (Ni), phosphorus (P), sulfur (S), silicon (Si), and/or niobium (Nb) are within certain set ranges. When any of the alloying materials is outside of the range, loss of both high yield strength at elevated temperature and thermal conductivity may occur. In one embodiment, the weight percentage ranges of C, Mo, and/or Nb are important. In another embodiment, the weight percentage ranges of C and/or Mo are important.

In one embodiment, the lean alloy steel includes, in weight percent (%), 0.20 to 0.60% C, 0.8 to 1.5% Cr, 0.8 to 1.5% Mo, 0.15 to 0.60% V, 0.20 to 0.60% Mn, 0.30 to 0.70% Ni, up to 0.02% P, up to 0.02% S, up to 0.40% Si, 0.03 to 0.06% Nb, and the balance essentially Fe. Specifically, in one embodiment, the lean alloy steel includes less than 0.35% C, more than 1.2 to 1.5% Mo, about 0.35 to 0.45% V, and about 0.8 to 0.9% Cr. In another embodiment, the lean alloy steel includes about 1% Mo, about 0.3% V, and about 1.0% Cr. In yet another embodiment, the lean alloy steel has less than 0.30% V.

In another embodiment, the lean alloy steel includes, in weight percent (%), 0.25 to 0.45% C, 0.8 to 1.2% Cr, 0.8 to 1.2% Mo, 0.20 to 0.45% V, 0.30 to 0.55% Mn, 0.35 to 0.55% Ni, up to 0.015% P, up to 0.015% S, up to 0.35% Si, 0.03 to 0.06% Nb, and the balance essentially Fe.

In yet another embodiment; the lean alloy steel includes, in weight percent (%), 0.25 to 0.35% C, 0.9 to 1.1% Cr, 0.9 to 1.1% Mo, 0.35 to 0.45% V, 0.45 to 0.55% Mn, 0.45 to 0.55% Ni, up to 0.015% P, up to 0.010% S, up to 0.25% Si, 0.03 to 0.05% Nb, and the balance essentially Fe.

Typical roll shell alloys used in aluminum strip casting are shown in FIG. 2. In certain embodiments of the present invention, all of the alloys are processed by first heating to 1750° F. (or 954.4° C.), holding to reach a uniform temperature, quenching in oil or water-polymer mixtures and then given a double temper treatment in the range of 1025° F. to 1100° F. (or 551.7 to 593.3° C.) followed by air cooling. The resulting microstructure is a very uniform tempered martensite.

One of the first alloys used for strip casting has a much lower alloy composition than H-13 and is designated as T-245. It had good high strength properties but suffered from premature heat checks, which significantly reduced production rates. Also, the heat checks propagated rapidly so that complete shell breakage frequently occurred, often during the surface machining phase of the reconditioning process between casting campaigns, and sometimes during the actual casting operation with disastrous results.

The attempt to improve the safety and service life during casting was made by increasing the alloy content, predominantly Cr to 2%, Mo to 1% and V to 0.3% (i.e., T-244 in FIG. 2). In one embodiment, the roll shells made at T-244 has an increased service life and a decrease in catastrophic failures. In another embodiment, the roll shells have a further increased service life by incorporating Cr (up to 3%), Mo (up to 1.5-2%) and V (up to 0.5%) to the alloying material. These alloys along with a comparative ally are show in FIG. 2 and FIG. 3 as HS-521. The trend in the industry has been to increase Cr, Mo and V toward the H-13 composition to improve service life.

In one embodiment, the improvement in service life can be achieved by increasing the elevated temperature yield strength of the shell near the temperature of molten aluminum (1200° F.). In this way, a greater extent of the expansion and contraction from the thermal cycling, which occurs at the shell surface during the casting process, is allowed to occur in the elastic phase of the shell expansion rather than the plastic phase, when thermal fatigue is most active. (Further details can be found in U.S. Pat. No. 5,599,497, which has been incorporated by reference herein in its entirety.) Referring now to FIG. 4, there is shown a table of elevated Temperature (1200° F.) Mechanical Properties of Roll Shell Alloys. As can be seen, the increase in yield strength of T-245, T-244 to HS-521, and comparative alloy correlates with an increase in the alloy content. It is believed that such an increase in yield strength is a result of increasing amounts of high temperature alloy carbides, such as VC and $Mo_2C$, acting as precipitation strengtheners. In certain embodiments, a small amount of NbC can be used as a strengthener. In other embodiments, Cr carbides are in solid solution at molten aluminum temperatures, and are not expected to add to the elevated temperature yield strength.

In other embodiments, improvement in the shell service life and quality can be achieved by melt processing to a low sulfur level and/or low hydrogen content. High hydrogen content can create flakes and subsequently thermal ruptures in the steel. Thus, in one embodiment, the hydrogen content is kept at 1.5 ppm (based on the total weight of the shell) or below.

In one embodiment, the alloy content of Cr, Mo, and V increases, while a small corresponding amount of C content is decreased to improve elevated temperature properties. In one embodiment, C is decreased from 0.5% to 0.3% C (or from about 0.5% to about 0.3% C). In this way, the incidence of quench cracking can be further reduced or prevented. Further, the change in the alloy content of the shell imparts lowered hardness of the shells and improved room temperature properties so that the shell is easier to handle during the surface-reconditioning process without incurring cracking defects during machining.

Figure 6:
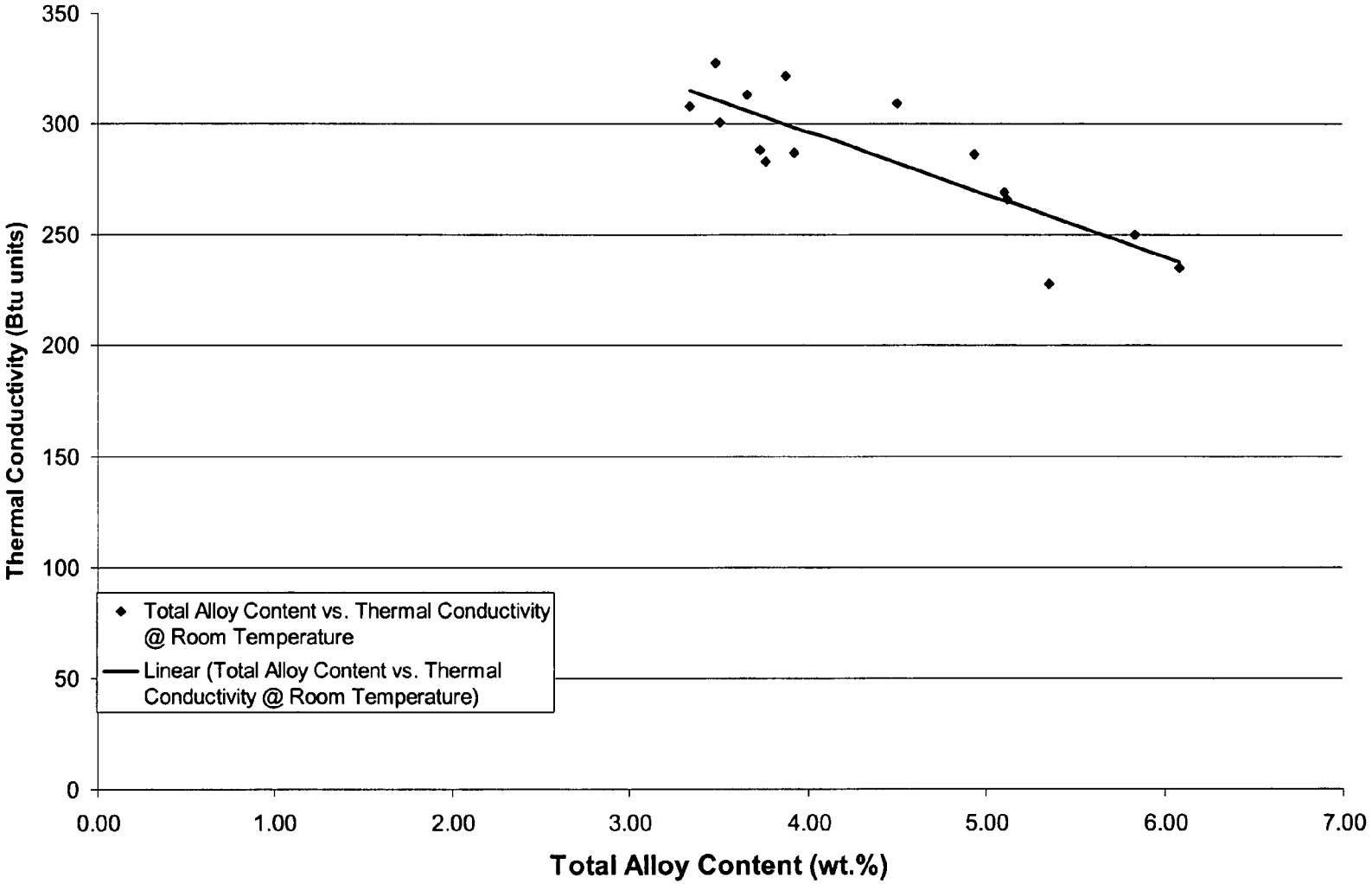
FIG. 6 a graph illustrating the thermal conductivity of an alloy as a function of the total alloy content according to certain embodiments of the present invention.

While heat checking or craze cracking can be significantly reduced to improve the service life of roll shells, the thermal conductivity of the alloys can decrease correspondingly. In general, increasing the total alloy content in steel or alloy steel decreases the thermal conductivity of steel over a wide range of temperatures. (See. e.g., Data Ref. Pipe and Tubes at for Elevated Temperature Service, Bulletin No. 26, National Tube Co., Pittsburgh, Pa., which is incorporated by reference herein in its entirety.) This drop in thermal conductivity reduces the rate of heat removal, and consequently reduces the production rate during aluminum strip casting. FIGS. 5 and 6 are data and graph, respectively, illustrating drops in thermal conductivity as the alloy content of the roll shells increases.

In one embodiment, a leaner alloy composition (i.e., HSC-621 shown in FIG. 5) is provided. The alloy, while retaining the elevated temperature yield strength, which is one of the features important to retard the growth of surface heat checks, has much greater thermal conductivity than the currently used alloys.

Figure 7:
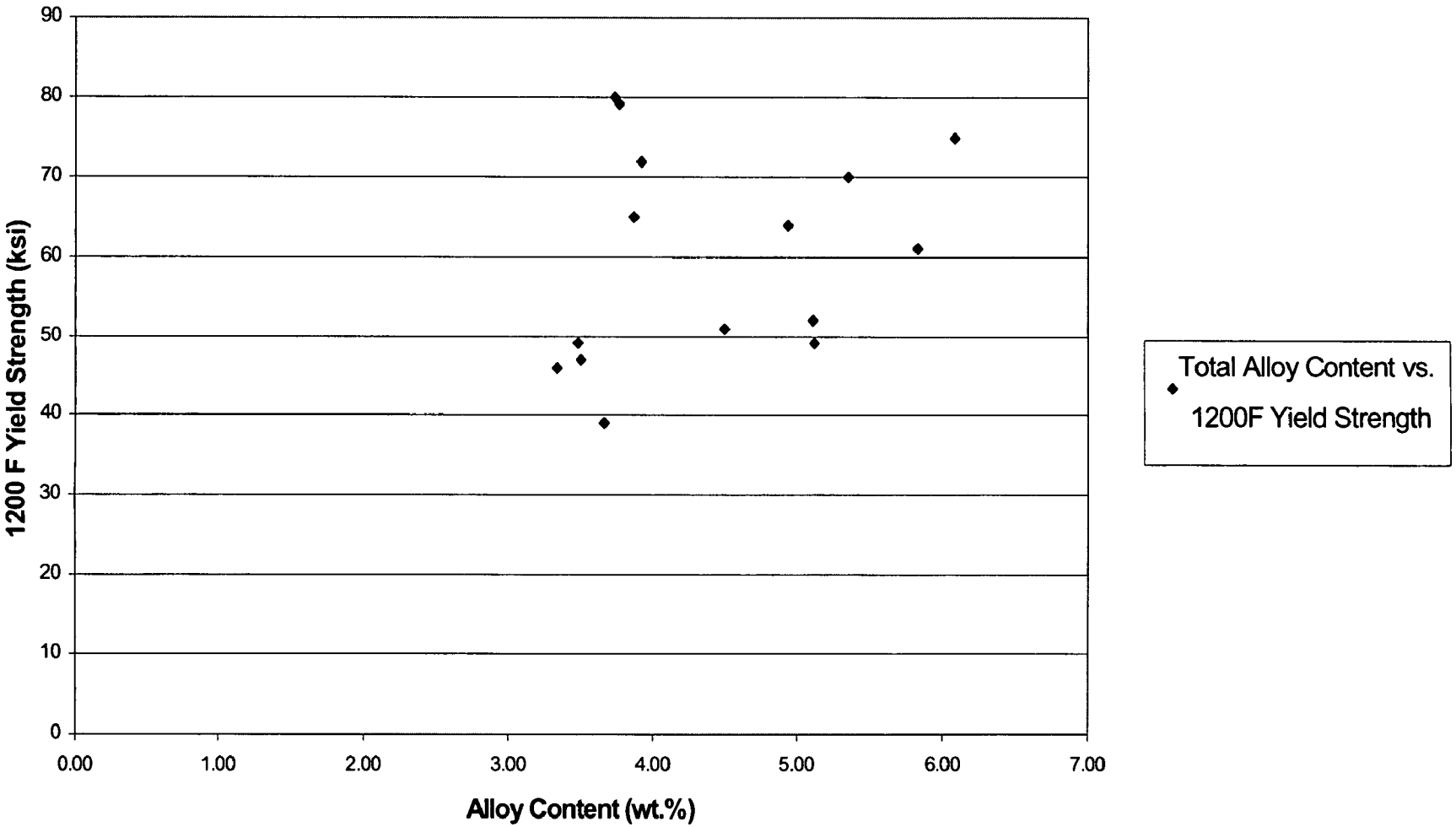
FIG. 7 is a graph illustrating the yield strength at 1200° F. of an alloy as a function of the total alloy content according to various embodiments of the present invention.
Figure 8:
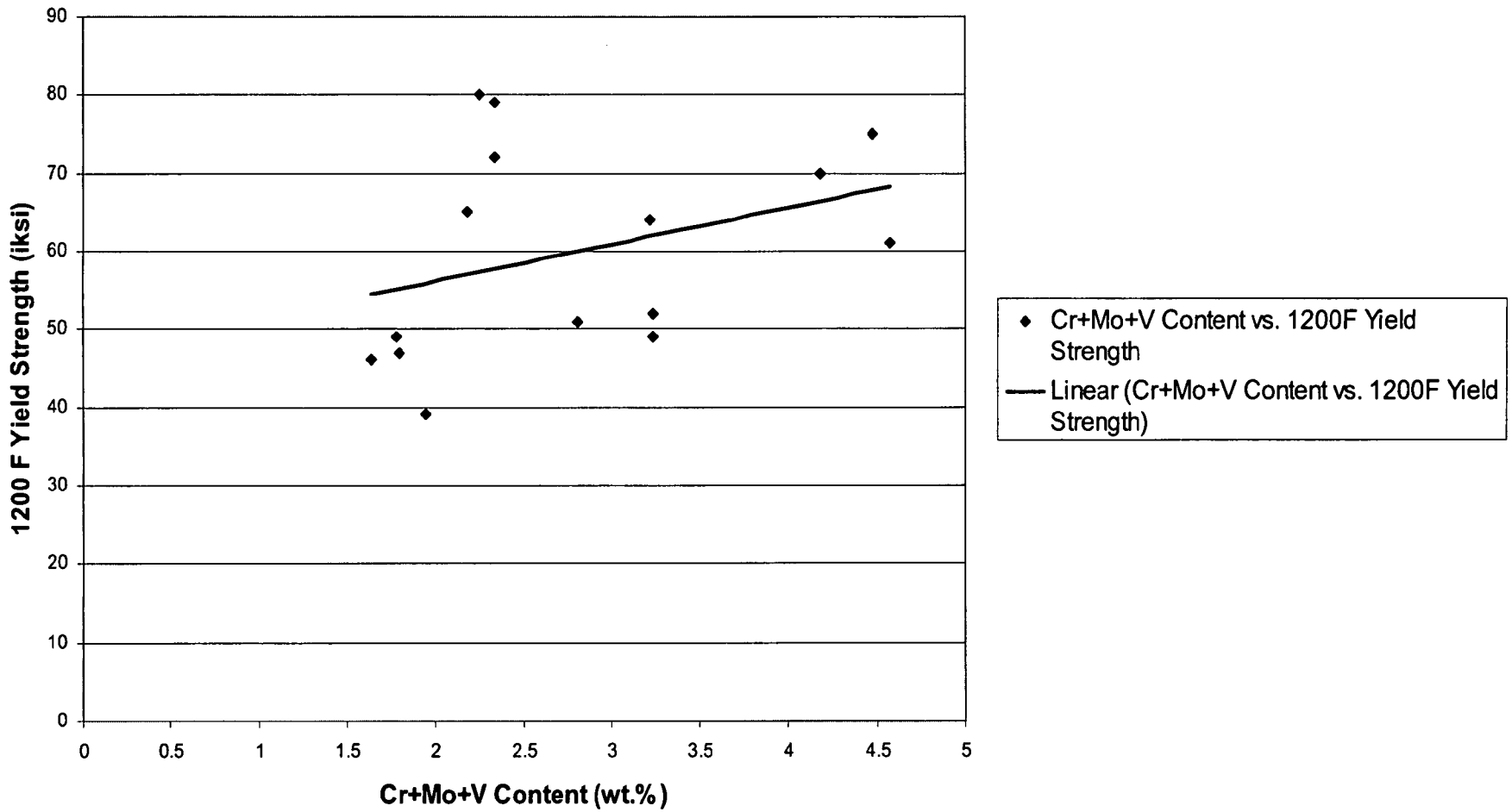
FIG. 8 is a graph illustrating the yield strength at 1200° F. of an alloy as a function of the content of Cr, Mo, and V according to certain embodiments of the present invention.

FIG. 7 shows a plot of the yield strength at 1200° F. of roll shells steel as a function of the total alloy content. The major alloy content includes several elements such as Cr, Mo, and V. Detailed data of the plot is provided in a table format (FIG. 2). As can be seen, the data spread of the yield strength is rather scattered at the low end of the alloy content. However, the spread is narrowed and directed upwardly as the alloy content increases. FIG. 8 shows a trendline of the data using a linear regression method. Generally, the trend shows improved yield strength as the amount of the total alloy content of Cr, Mo, and V increases.

Figure 9:
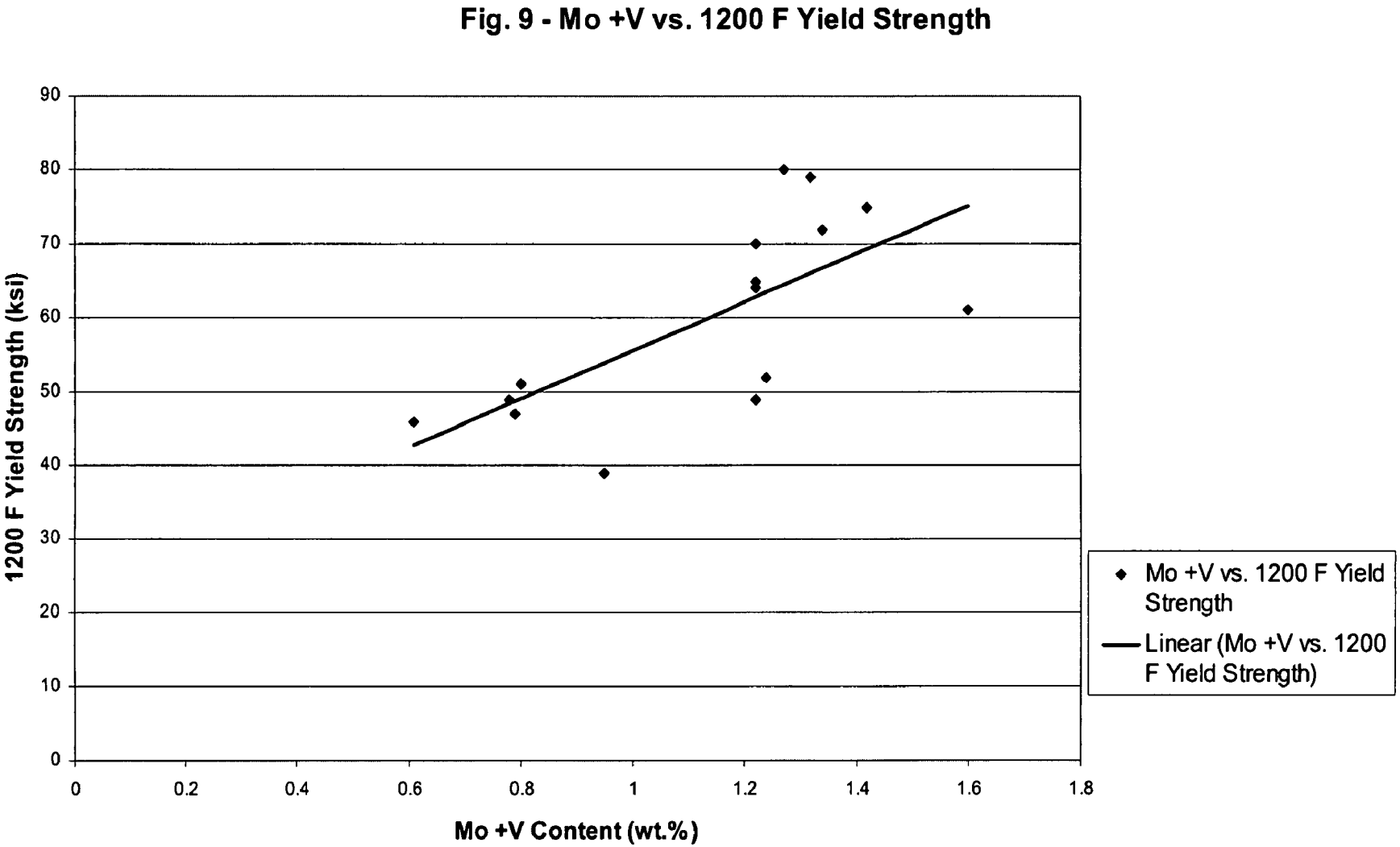
FIG. 9 is a graph illustrating the yield strength at 1200° F. of an alloy as a function of the content of Mo, and V according to certain embodiments of the present invention.

Referring now to FIG. 9, a plot of only the Mo and V content vs. yield strength is shown. Again, the plot shows a trend toward higher strength levels at higher Mo and V contents. When the effect of V is isolated and only the Mo content vs. yield strength is plotted (FIG. 10), a definite strengthening effect of Mo can be seen.

Figure 11:
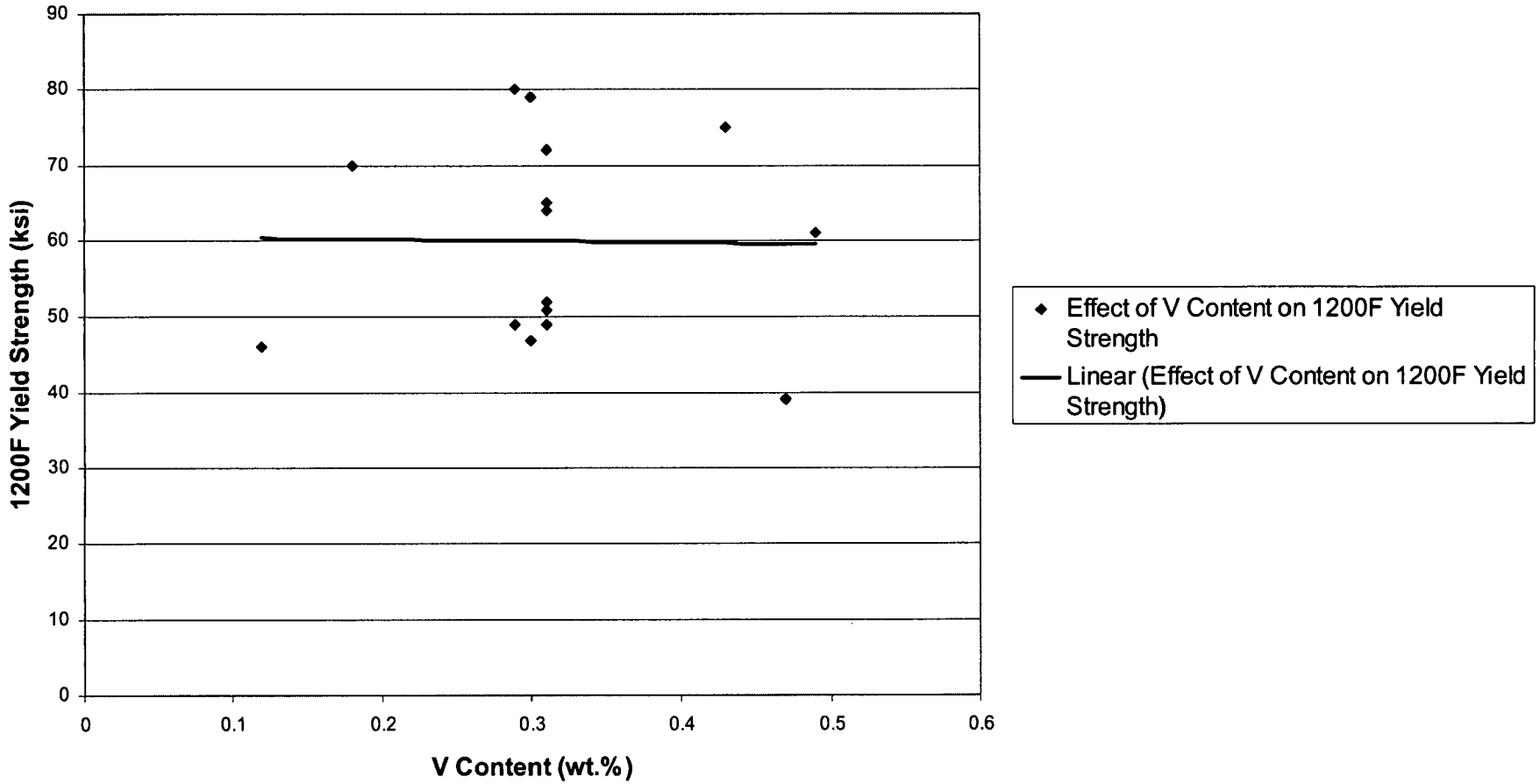
FIG. 11 is a graph illustrating the yield strength at 1200° F. of an alloy as a function of the V content according to certain embodiments of the present invention.
Figure 12:
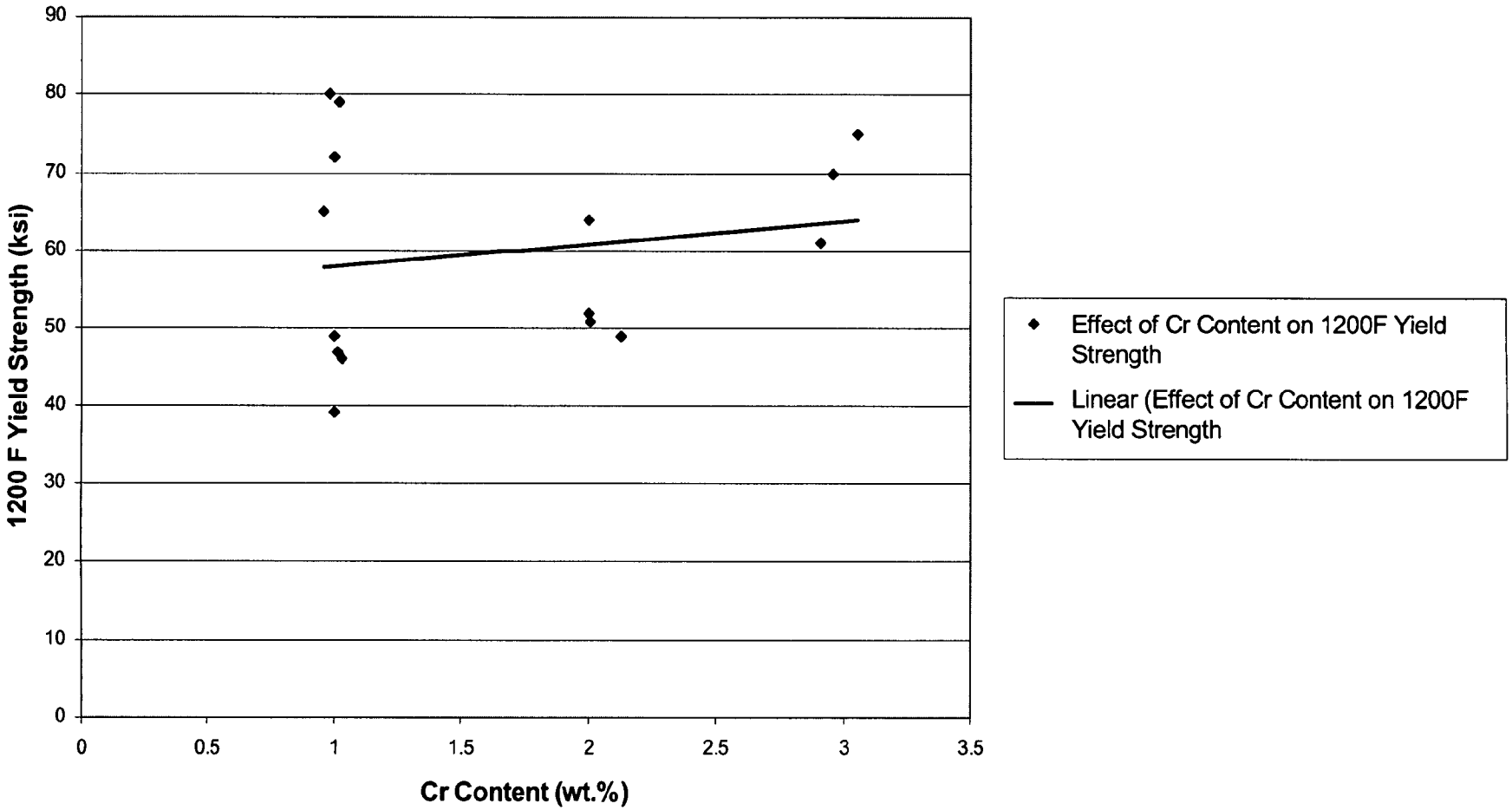
FIG. 12 is a graph illustrating the yield strength at 1200° F. of an alloy as a function of the Cr content according to one embodiment of the present invention.

When plotting only the V content vs. 1200° F. yield strength in FIG. 11, it can be seen that V does not have a significant increasing effect on yield strength over a low concentration range, (e.g., from about 0.1 to 0.5 wt %). Similarly, when plotting only the Cr content vs. yield strength in FIG. 12, only a small strengthening effect was observed.

The data indicates that making a significant reduction in the Cr content (e.g., from 3% to 1%), while keeping the Mo content at about 1% and the V content at about 0.3%, will allow the caster shell steel to develop high 1200° F. yield strength after heat treating and at the same time, have significant improvement in thermal conductivity. In one embodiment, the conductivity of the caster or roll shell steel increases up to 20% over alloys containing 3% Cr and up to 7% over alloys containing 2% Cr.

As such, it is believed that there is a complex strengthening relationship between the V and Mo carbides that are present in the alloy. FIG. 13 shows a table of various amounts of alloy carbide possible at the melting point of aluminum (approximately 1250° F.). In various embodiments, Nb is added to the alloys to insure that the high elevated temperature yield strength can be maintained as the alloy content is decreased to improve the thermal conductivity. FIG. 14 is a graph of the yield strength as a function of the percent of total C as an alloy-carbide using the data in FIG. 13. The graph shows an increasing trend toward higher yield strengths as the percent of available C is tied up as alloy precipitates. When about 30 to 40% or higher of the C is tied up as an alloy carbide the yield strengths reach 60 to 80 ksi and therefore provides improved resistance to heat check formation. The trend line shown is from a $2^{nd}$ order logarithmic regression. While it cannot be easily determined which alloy carbide has the greatest affect, it is believed that a combination of VC and $Mo_2C$ has a significant effect on the yield strength. In various embodiments of the present invention, tungsten is not employed because it is believed tungsten carbide ($W_2C$) interferes with and decreases the quality of other metal carbides formation. Further as tungsten carbide precipitates it is not as effective as a grain refiner and coarse grains may develop in the alloy steel, thereby further decreasing the quality characteristics of the low alloy steel.

Figure 10:
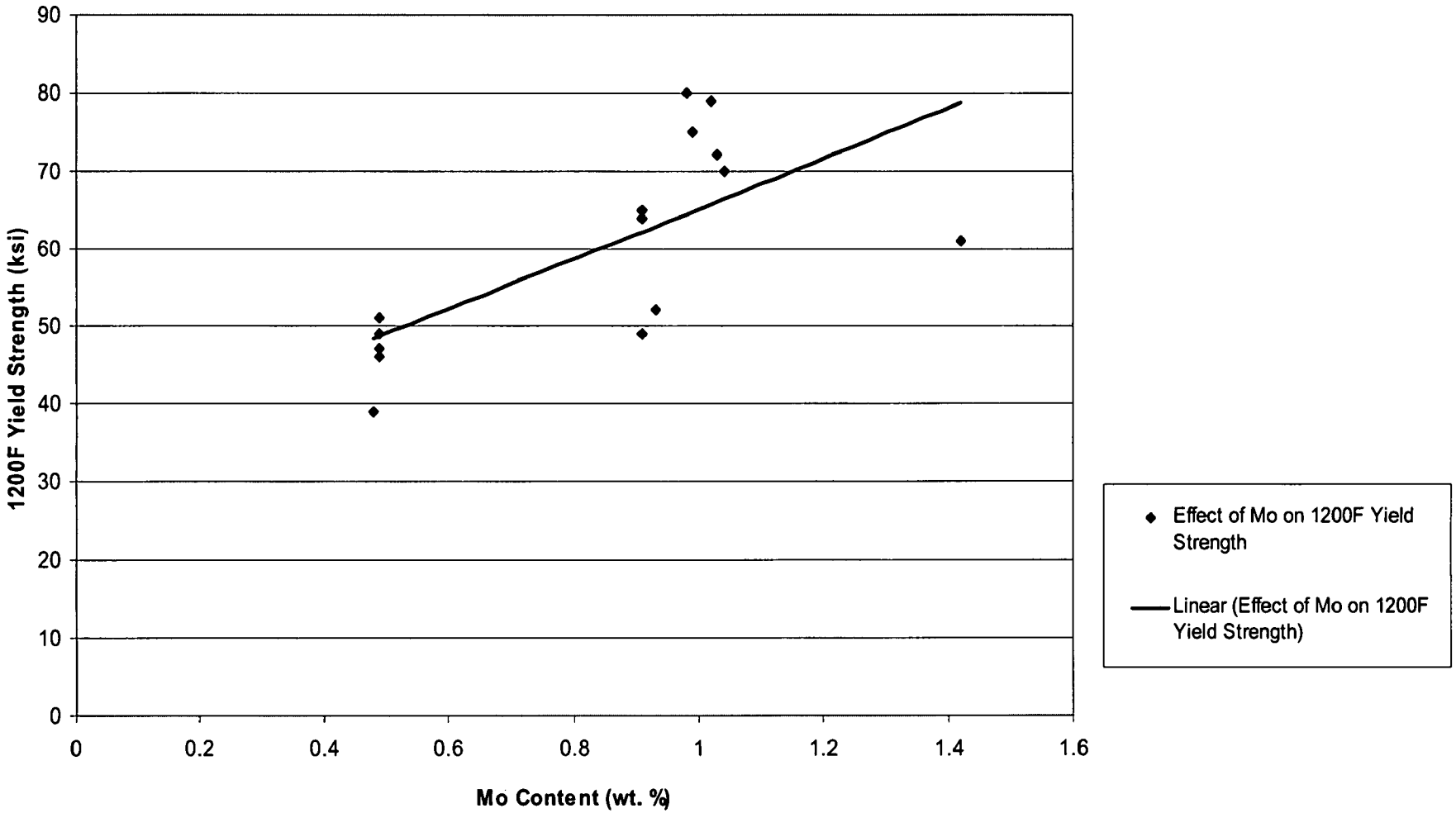
FIG. 10 is a graph illustrating the yield strength at 1200° F. of an alloy as a function of the Mo content according to certain embodiments of the present invention.

Accordingly, in one embodiment, the $Mo_2C$ content seems to be a significant factor (FIG. 10). That is, Mo is a strong carbide-forming element, thereby increasing the high temperature strength necessary for thermal fatigue resistance at high temperatures. Additionally, it is believed that Mo counteracts temper embrittlement during heat treatment of the steel. Accordingly, in one embodiment, the Mo content is present in an amount between 0.80 and 1.50 wt %, or more specifically, between 1.2 to 1.5 wt %. If the amount of Mo is less than 0.80 wt %, significant improvement in high temperature strength may not be possible. If the amount of Mo is higher than 1.50 wt %, a loss in thermal conductivity may occur. In another embodiment, the molybdenum content ranges from about 0.90% to about 1.10%. Accordingly, in various embodiments, the alloy steel for use in high and low temperature exposure applications (e.g., roller shells for casting molten aluminum into strips) includes an increased amount of Mo but with a decreased amount of other alloying elements. In this way, the lean alloy can impart high resistance to surface heat checking because of its high temperature yield strength due to the high content of Mo, and at the same time high casting speed because of the low alloy content, which results in higher thermal conductivity.

In one embodiment, the lean alloy includes Nb to further increase the effectiveness of alloy formation.

In various embodiments, alloys T-244LoCrC, T-244LoCrC+Nb, and HSC-621 (shown in FIG. 14) have greater than 40% of the C tied up as alloy carbide and 1200° F. yield strengths above 70 ksi. In most of these embodiments, the total alloy composition (including C) is less than 5%, or specifically, less than 4% so that the alloys have high thermal conductivity. These alloys, however, still provide good yield strength in spite of the low alloying material content. (see FIG. 6). This is possible because of the discussed ratios of alloying materials employed in the alloys. Conversely, in other prior art examples, the total amount of elements in a roll caster shell alloy other than Fe and C is required not to exceed 5 atomic %.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A roll caster shell for casting aluminum material, said shell comprising iron (Fe) alloyed with alloying constituents comprising, in weight percent (%) of said shell, from about 0.20% to less than 0.33% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% nickel (Ni), up to about 0.02% phosphorus (P), up to about 0.020% sulfur (S), and up to about 0.40% silicon (Si).

2. The roll caster shell of claim 1, wherein said shell comprises from about 0.03% to about 0.06% niobium (Nb).

3. The roll caster shell of claim 2, wherein said shell comprises about 1.0% Mo.

4. The roll caster shell of claim 2, wherein said shell comprises about 0.30% V.

5. The roll caster shell of claim 2, wherein said shell comprises about 1.0% Cr.

6. The roll caster shell of claim 2, wherein said shell comprises about 1.0% Mo, about 0.30% V, and about 1.0% Cr.

7. The roll caster shell of claim 1, wherein said shell comprises, from about 0.25% to less than 0.33% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, up to about 0.35% Si, and from about 0.03% to about 0.06% Nb.

8. The roll caster shell of claim 1, wherein said shell comprises, from about 0.25% to less than 0.33% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, up to about 0.25% Si, and from about 0.03% to about 0.05% Nb.

9. The roll caster shell of claim 1, wherein said shell comprises from about 0.25% to less than 0.33% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, and up to about 0.35% Si.

10. The roll caster shell of claim 1, wherein said shell comprises from about 0.25% to less than 0.33% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, and up to about 0.25% Si.

11. The roll caster shell of claim 1, wherein said shell comprises about 1.0% Mo.

12. The roll caster shell of claim 1, wherein said shell comprises about 0.30% V.

13. The roll caster shell of claim 1, wherein said shell comprises about 1.0% Cr.

14. The roll caster shell of claim 1, wherein said shell comprises about 1.0% Mo, about 0.30% V, and about 1.0% Cr.

15. The roll caster shell of claim 1, wherein said shell comprises more than 1.2% and to about 1.5% Mo.

16. The roll caster shell of claim 1, wherein said shell comprises less than 0.30% V.

17. The roll caster shell of claim 1, wherein said shell comprises from about 0.35% to about 0.45% V.

18. The roll caster shell of claim 1, wherein said shell comprises from about 0.8% to about 0.9% Cr.

19. The roll caster shell of claim 1, wherein said shell comprises more than 1.2% and to about 1.5% Mo, and from about 0.8% to about 0.9% Cr.

20. The roll caster shell of claim 1, wherein said shell comprises more than 1.2% and to about 1.5% Mo, from about 0.8% to about 0.9% Cr, and from about 0.35% to about 0.45% V.

21. The roll caster shell of claim 1, wherein the roll caster shell is a tube having substantially uniform martensite crystalline structure.

22. The roll caster shell of claim 1, wherein said shell comprises hydrogen at a concentration up to 1.5 ppm based on total weight of said shell.

23. An alloy steel utilized to form a roll caster shell, said alloy steel comprising iron (Fe) alloyed with alloying constituents comprising, in weight percent (%) of said alloy steel, from about 0.20% to less than 0.33% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% Ni, up to about 0.02% phosphorus (P), up to about 0.02% sulfur (S), and up to about 0.40% silicon (Si).

24. The alloy steel of claim 23, wherein said alloy steel comprises from about 0.03% to about 0.06% niobium (Nb).

25. The alloy steel of claim 23, wherein said alloy steel comprises from about 0.25% to less than 0.33% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, up to about 0.35% Si, and from about 0.03% to about 0.06% Nb.

26. The alloy steel of claim 23, wherein said alloy steel comprises from about 0.25% to less than 0.33% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, up to about 0.25% Si, and from about 0.03% to about 0.05% Nb.

27. The alloy steel of claim 23, wherein said alloy steel comprises from about 0.25% to less than 0.33% C, from about 0.8% to about 1.2% Cr, from about 0.8% to about 1.2% Mo, from about 0.20% to about 0.45% V, from about 0.30% to about 0.55% Mn, from about 0.35% to about 0.55% Ni, up to about 0.015% P, up to about 0.015% S, and up to about 0.35% Si.

28. The alloy steel of claim 23, wherein said alloy steel comprises from about 0.25% to less than 0.33% C, from about 0.9% to about 1.1% Cr, from about 0.9% to about 1.1% Mo, from about 0.35% to about 0.45% V, from about 0.45% to about 0.55% Mn, from about 0.45% to about 0.55% Ni, up to about 0.015% P, up to about 0.010% S, and up to about 0.25% Si.

29. The alloy steel of claim 23, wherein said alloy steel comprises hydrogen at a concentration up to 1.5 ppm.

30. The roll caster shell of claim 1, wherein said alloying constituents consist of, in weight percent (%) of said shell, from about 0.20% to less than 0.33% carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% nickel (Ni), up to about 0.02% phosphorus (P), up to about 0.020% sulfur (S), up to about 0.40% silicon (Si), optionally from about 0.03% to about 0.06% niobium (Nb), and residual amounts of copper (Cu) and aluminum (Al).

31. The roll caster shell of claim 1, said shell comprising iron (Fe) alloyed with alloying constituents comprising, in weight percent (%) of said shell, from about 0.20% to less than 0.33% C carbon (C), from about 0.8% to about 1.1% chromium (Cr), from about 0.8% to about 1.1% molybdenum (Mo), from about 0.20% to about 0.40% vanadium (V), from about 0.30% to about 0.55% manganese (Mn), from about 0.45% to about 0.55% nickel (Ni), up to about 0.02% phosphorus (P), up to about 0.020% sulfur (S), up to about 0.25% silicon (Si), and from about 0.03% to about 0.06% niobium (Nb).

32. A method casting aluminum material, comprising:

rotating a plurality of caster rolls, each including a roll caster shell, said shell comprising iron (Fe) alloyed with alloying constituents comprising, in weight percent (%) of said shell, from about 0.20% to less than 0.33% C carbon (C), from about 0.8% to about 1.5% chromium (Cr), from about 0.8% to about 1.5% molybdenum (Mo), from about 0.15% to about 0.60% vanadium (V), from about 0.20% to about 0.60% manganese (Mn), from about 0.30% to about 0.70% nickel (Ni), up to about 0.02% phosphorus (P), up to about 0.020% sulfur (S), and up to about 0.40% silicon (Si);

flowing molten aluminum to the caster rolls so that the molten aluminum solidifies before reaching the bite of the caster rolls; and hot rolling the solidified aluminum using the caster rolls.

* * * * *